United States Patent [19]

Tertinek et al.

[11] 4,232,980

[45] Nov. 11, 1980

[54] ROTARY POWER TROWEL

[75] Inventors: Christian T. Tertinek, Canandaigua; Alan J. Stone, Honeoye, both of N.Y.

[73] Assignee: Stone Construction Equipment, Inc., Honeoye, N.Y.

[21] Appl. No.: 1,786

[22] Filed: Jan. 8, 1979

[51] Int. Cl.[2] ..... E01C 19/22

[52] U.S. Cl. ..... 404/112; 192/129 R; 51/177

[58] Field of Search ..... 404/112, 133; 51/174, 51/177; 192/13 A, 129 R, 144

[56] References Cited

U.S. PATENT DOCUMENTS

| | | | |
|---|---|---|---|
| 2,198,929 | 4/1940 | Whiteman | 404/112 |
| 2,277,389 | 3/1942 | Conway | 404/112 |
| 2,342,445 | 2/1944 | Allen | 404/112 |
| 2,394,274 | 2/1946 | Troxell | 404/112 |
| 2,594,331 | 4/1952 | McCrery | 404/112 |
| 2,641,169 | 6/1953 | Ytterberg | 404/112 |
| 2,689,507 | 9/1954 | McCrery | 404/112 |
| 2,734,932 | 2/1956 | Barnes | 404/112 X |
| 2,875,676 | 3/1959 | Thieme | 404/112 |
| 2,888,863 | 6/1959 | Eisenbeis | 404/112 |
| 3,232,188 | 2/1966 | Fronnauer | 404/133 X |
| 3,259,033 | 7/1966 | Kelley | 404/112 |
| 3,296,946 | 1/1967 | Cagno | 404/112 |
| 3,331,290 | 7/1967 | Harding | 404/112 |
| 3,361,044 | 1/1968 | Wolf | 404/112 |
| 3,791,754 | 2/1974 | Zochil | 404/112 |
| 4,046,483 | 9/1977 | Sutherland | 404/112 |
| 4,046,484 | 9/1977 | Holz | 404/112 |

*Primary Examiner*—Nile C. Byers, Jr.

*Attorney, Agent, or Firm*—Clarence A. O'Brien; Harvey B. Jacobson

[57] ABSTRACT

A rotary power trowel having a safety clutch, a gyroscopic stabilizing ring, blade pitch control, and an adjustable handle. The safety clutch employs a belt tension adjustment to act as a brake on the drive belt when activated either manually or, in an emergency, automatically by a lever on a handle near the operator. When the rotary trowel goes out of control in an emergency, centrifugal force activates the lever and disengages the driving force and acts to brake the belt in less than one turn of the handle. The gyroscopic stabilizer ring lowers the rotary trowel center of gravity and generates a stabilizing effect. Blade tilting is accomplished through a turning knob located at the end of the adjustable handle, which is adjustable to the height of the operator.

18 Claims, 12 Drawing Figures

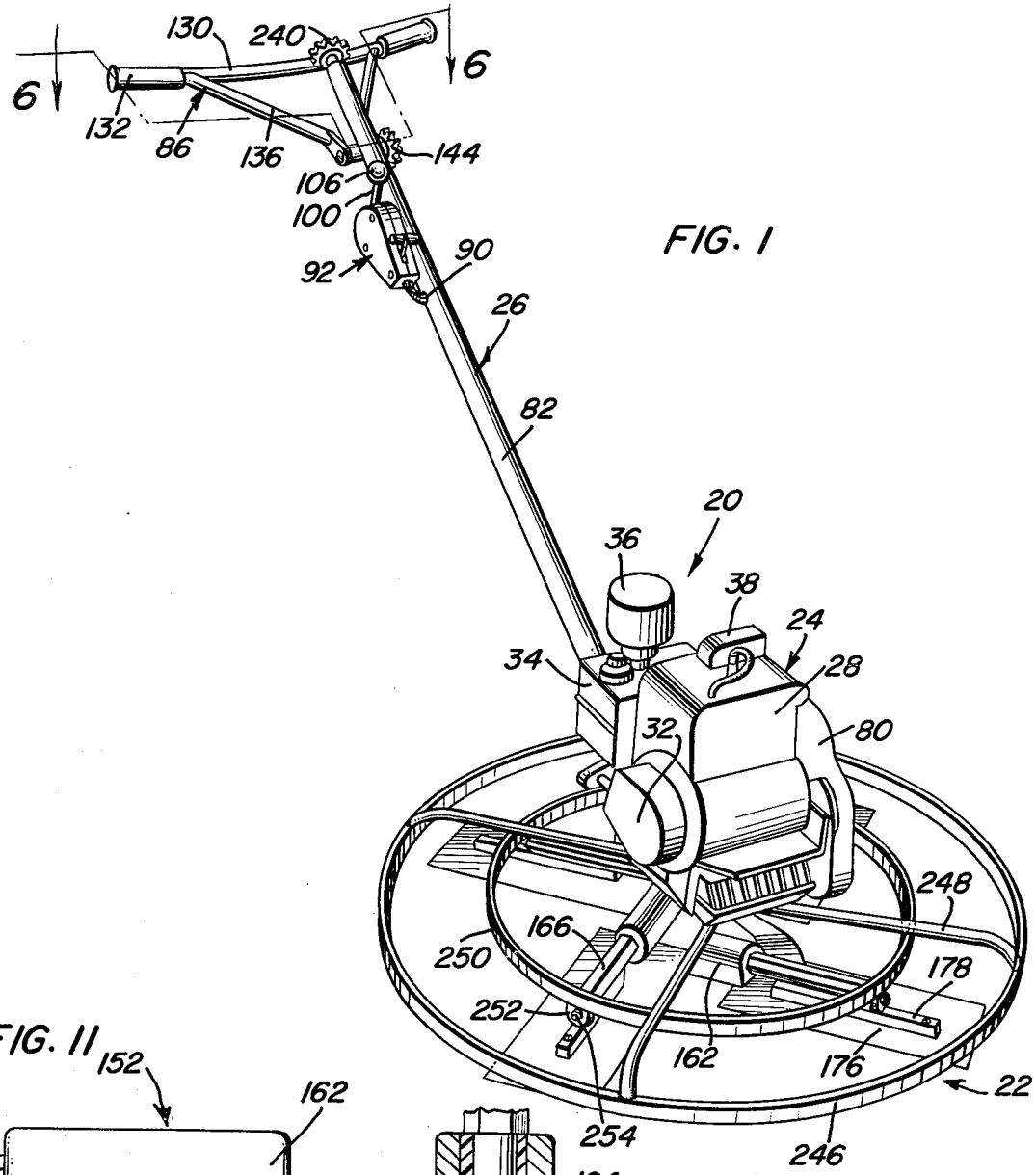
FIG. 1
FIG. 11
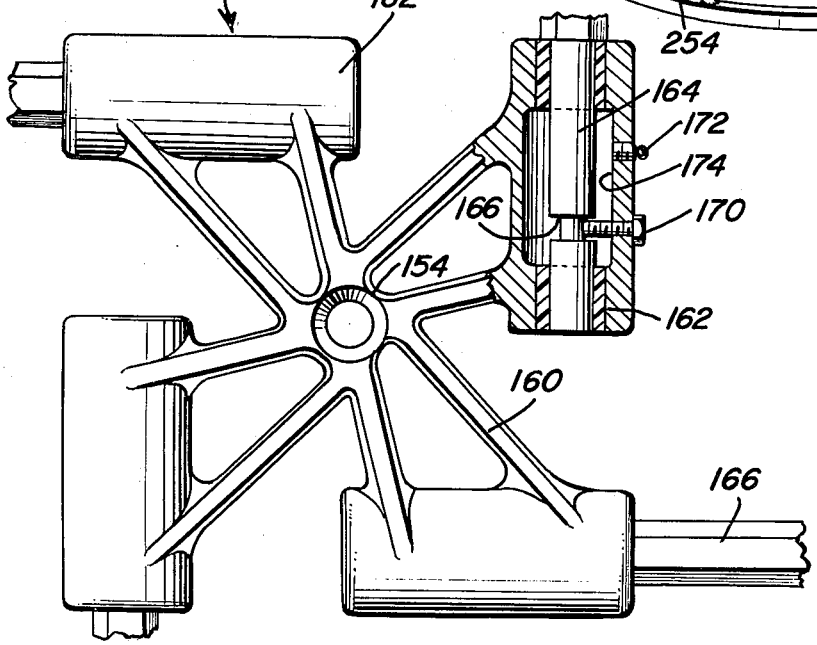

ROTARY POWER TROWEL

BACKGROUND OF THE INVENTION

1. Field of the Invention

The invention relates generally to a rotary power trowel machine for finishing concrete, more particularly, to a rotary power trowel having blades with controllable tilt, a gyroscopic stabilizer ring, a safety clutch mechanism for rapid disengagement of the drive mechanism if the device goes out of control, and a handle adjustable to the height of the operator.

2. Description of the Prior Art

During recent years, mechanized equipment for troweling large surface areas of concrete have been developed and used. Wet concrete is poured into a form in the construction of floors, sidewalks, highways, and the like, and is troweled during its hardening period in order to produce a smooth finished surface free of bubbles. During the finishing process, water rises to the surface of the wet concrete and evaporates while chemical reactions within the concrete cause it to harden and set. Finishing with a trowel or similar tool is believed to compact the concrete and to increase its strength. Power driven equipment is known and is in commercial use for finishing concrete more rapidly and with greater uniformity and quality of surface smoothness than is achieveable by manual troweling.

Early rotary troweling machines are disclosed in U.S. patents to Whiteman (U.S. Pat. No. 2,198,929, issued Apr. 30, 1940); Conway (U.S. Pat. No. 2,277,389, issued Mar. 24, 1942); Allen (U.S. Pat. No. 2,342,445, issued Feb. 22, 1944); Troxell (U.S. Pat. No. 2,394,274, issued Feb. 5, 1946); and McCrery (U.S. Pat. No. 2,594,331, issued Apr. 29, 1952). The McCrery patent is representative and exemplary of early rotary trowelers, and the basic design described is still used in modern conventional rotary powered trowelers. As is generally disclosed in the patents above, such trowelers typically comprise a housing, an engine enclosed within the housing, a rotatable shaft connected to the motor either directly, as in the Troxell and Conway patents, or indirectly, as in the Allen, Whiteman and McCrery patents. The rotatable shaft extends vertically downwardly from the housing and a plurality of spider arms extend between the shaft and troweling blades. A circular guard ring extending outside the periphery of the blades is supported slightly above the surface of the concrete troweled by the blades through attachment to the housing by means of stabilizer arms. A handle extends upwardly and outward from the housing and is equipped with manual controls. In operation, the engine is started, causing the troweling blades to rotate. The operator manipulates the machine through the handle along the surface of wet concrete, allowing the rotating blades to exert troweling action on the concrete surface. Initially, the troweling blades are oriented nearly parallel to the concrete surface, but as the concrete hardens, the blades can be tilted, such as in the manner provided in the Whiteman patent, to increase the effective pressure on the concrete surface brought about by the troweling blades striking the concrete surface obliquely.

These and other patents exemplifying rotary troweling machines, or components thereof, are as follows:

| | |
|---|---|
| U.S. Pat. Nos.: 2,888,863 | 2,882,805 |
| 2,101,895 | 2,351,278 |

-continued

| | |
|---|---|
| 2,208,801 | 2,468,981 |
| 2,434,408 | 2,556,983 |
| 3,259,033 | 2,108,470 |
| 3,331,290 | 3,062,107 |
| 3,791,754 | 3,412,657 |
| 3,296,946 | 2,689,507 |
| 3,402,647 | 4,046,483 |
| 2,662,454 | 4,046,484 |

Rotary troweling machines have used many clutching and emergency stopping methods, the simplest or most common clutch being the mechanical centrifugal clutch. On an engine which idles, the clutch is disengaged, but an engine speed increases, as controlled through an engine throttle, the centrifugal clutch engages to drive the trowel. For emergency stopping in the event the device leaves the operator's hands, a centrifugal engine kill switch, such as is exemplified in U.S. Pat. No. 3,331,290 to Harding, Jr., is used. Such a switch closes automatically to kill the engine when loss of control causes the handle to swing in a circle centered on the trowel blades. However, devices with a centrifugal engine kill switch are hazardous because in practice two complete turns of the handle generally are made before the device comes to a stop, and the operator will probably have been hit during the first revolution. Furthermore, a hazardous condition can exist when an engine so equipped is started. Upon starting the engine the centrifugal clutch will not become engaged if the initial engine speed is at an idle, and the operator can safely move from his position in starting the engine to a position to control the action of the trowel. However, if the initial engine speed is sufficiently greater than idling speed, such as could occur if the throttle setting is too high initially, the centrifugal clutch will engage the trowel before the operator assumes position to control action of the trowel. If the starting operation involves pulling a starting cord connected to the engine, the operator is in a quite vunerable position with respect to such premature engagement, and is subject to serious injury if struck by the handle.

A second method used for rotary power trowel clutching is a normally disengaged hand clutch, controlled by a lever on the handle of the device. When manually activated, the lever brings together a split sheave clutch on the engine shaft, and when the lever is released, the handle can usually be expected to stop rotating within one turn. Constructed to disengage automatically when not held by the hand of the operator on the lever, the hand clutch mechanism can be a safer method of clutching the trowel than the centrifugal clutch. However, the hand clutch in practice causes hand fatigue on the operator, particularly during prolonged operation of the device. To overcome their fatigue problem, operators have been known to circumvent operation of the hand clutch by fastening a handkerchief around the lever or using other means to continuously engage the clutch lever. When operating in such a condition, no safety control whatever exists on the device, and it could spin indefinitely out of control when so operated.

The present invention overcomes the shortcomings enumerated above by providing an improved safety clutch mechanism requiring no manual disengagement by the operator, and capable of quickly stopping a rotary power trowel out of control.

Most rotary power trowel devices have fixed trowel handles not adjustable to the height of the operator, causing physical discomfort to operators who happen to be shorter or taller than the average height for which the handle is designed. A rotary trowel is known, however, having a handle which pivots at the connecting point to the trowel gear case, held in that position by a connecting rod which is connected near the midpoint ot the handle and to the top of the engine. Such an arrangement suffers from problems incident to transmission of engine vibration directly to the handle and thus to the operator. The present invention overcomes problems of prior non-adjustable trowel handle, or trowel handles which transmit engine vibration, by providing an improved adjustable trowel handle.

Most present rotary trowels provide for tilting their blades by means of a hand knob located near the end of the control handle, such as is disclosed in the Whiteman patent (U.S. Pat. No. 2,198,929). Turning of the hand knob causes a cable or chain extending along the handle tube and exiting near the gear case to act upon a fork-like member with a horizontal rod as a pivot point to act downwardly upon a pressure plate linked in some manner to a blade tilting means. In the present invention, an improved blade tilting construction is disclosed which allows precision blade adjustment, smooth operation of the blade pitch control, and absence of blade "flopping" when the rotary trowel is lifted.

Rotary power trowels are known which employ stabilizer rings rotating near the end of the troweling arms to impart strength to the assembly. While light trowels and heavy trowels have been manufactured, the light trowels being adaptable for use with concrete which is soft, and the heavy trowels being useful when the concrete has set somewhat further, the present invention provides an attachment in the form of a heavier gyroscopic stabilizer ring. Besides providing a single machine having the versatility of two separate trowels of different weight, the gyroscopic stabilizer ring enhances trowel balance, as well as adds weight. Greater stability results from lowering of the trowel center of gravity and the gyroscopic effect it creates. Conventional methods to increase trowel weight, such as adding concrete blocks, or the like, raise the center of gravity, provide no gyroscopic effect since they do not rotate, cannot be safely secured, and result in an unbalanced, as well as hazardous, mode of operation.

SUMMARY OF THE INVENTION

It is accordingly an object of the present invention to provide a rotary power trowel having a safety clutch mechanism requiring no manual engagement and capable of automatically stopping a swinging trowel handle in less than one turn.

It is another object of the invention to provide a trowel handle adjustable to the height of the operator without direct connection with the engine.

Still another object of the invention is to provide an improved means for tilting troweling blades of the device.

Yet another object of the invention is to provide a gyroscopic stabilizer ring to lower the trowel center of gravity, increase the trowel weight, and generate a gyroscopic effect to increase trowel operational stability.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of an improved rotary power trowel constructed in accordance with the preferred embodiment of the invention.

FIG. 11 is a top plan view of a trowel blade support spider with one sleeve shown in section.

DESCRIPTION OF THE PREFERRED EMBODIMENTS

Figure 2:
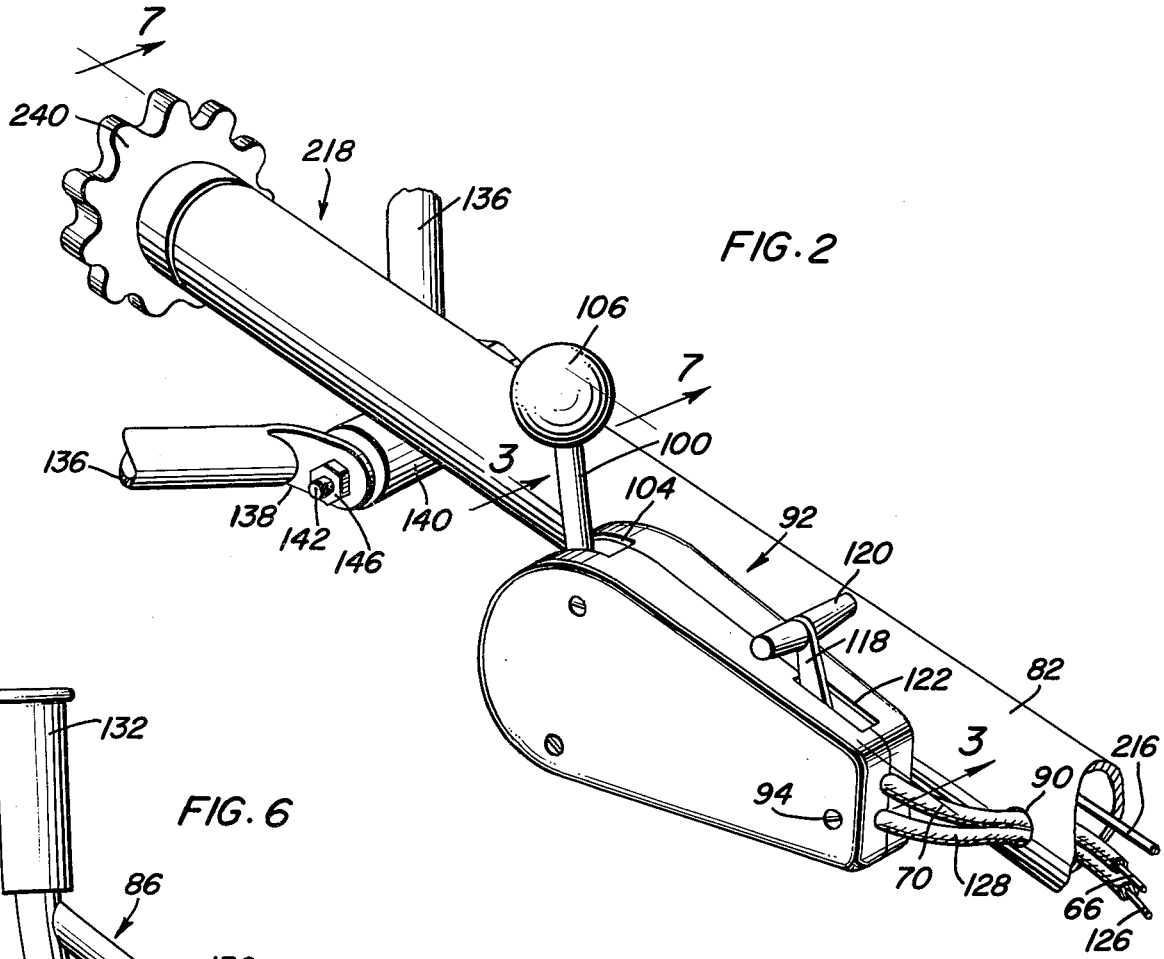
FIG. 2 is an enlarged, perspective view of the upper central portion of the handle of the device of FIG. 1.
Figure 6:
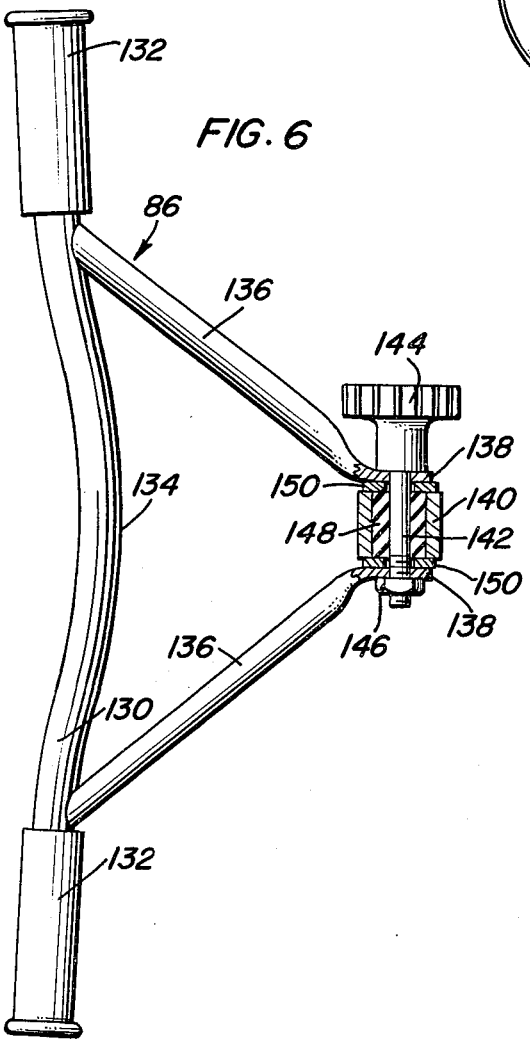
FIG. 6 is an enlarged, fragmentary, top plan view, partly sectional, taken substantially upon a plane passing along section line 6—6 on FIG. 1, showing details of the improved adjustable handle.

The rotary power trowel of the present invention is generally designated by reference numeral 20 and is illustrated in its entirety in FIG. 1. The trowel 20 includes a rotary troweling blade assembly 22 driven by a prime mover 24 such as an air cooled internal combustion engine or the like with operation of the trowel 20 being controlled by an operator through a handle assembly generally designated by numeral 26.

The prime mover 24 is preferably in the form of a conventional air cooled gasoline engine 28 of the horizontal output shaft type and which includes a horizontally disposed output drive shaft 30 at one side of the engine. The engine 28 also includes the usual starter assembly 32 connected with the shaft 30 at the opposite side of the engine and also includes the usual fuel tank 34, intake air filter 36, and other conventional components such as a protective cover 38 for the spark plug and connection between the spark plug and spark plug wire.

Disposed below and rigidly affixed to the base of the engine 28 is a gear box 40 having a horizontal input shaft 42 projecting from one side thereof in parallel relation to the output shaft 30 of the engine 28. The shaft 30 is provided with a pulley 44 rigidly affixed thereto in a detachable manner which is in alignment with and generally vertically spaced above a pulley 46 on the input shaft 42 of the gear box 40 and a drive belt 48 encircles the pulleys 44 and 46 for transmitting power from the output shaft 30 of the engine 28 to the input shaft 42 of the gear box 40 with the belt 48 preferably being a V-belt and the pulleys 44 and 46 including a V-shaped peripheral groove. The gear box 40 includes any suitable reduction gear mechanism such as a worm and pinion gear arrangement and is preferably oil filled with a sight gauge being provided on one side thereof and exposed peripheral portions of the gear box 40 are provided with projecting fins 50 to maintain the oil in the gear box at a desired temperature level. Also, the gear box 40 includes a vertically depending output shaft 52 for driving connection with the troweling blade assembly 22 as illustrated in FIG. 10.

Figure 4:
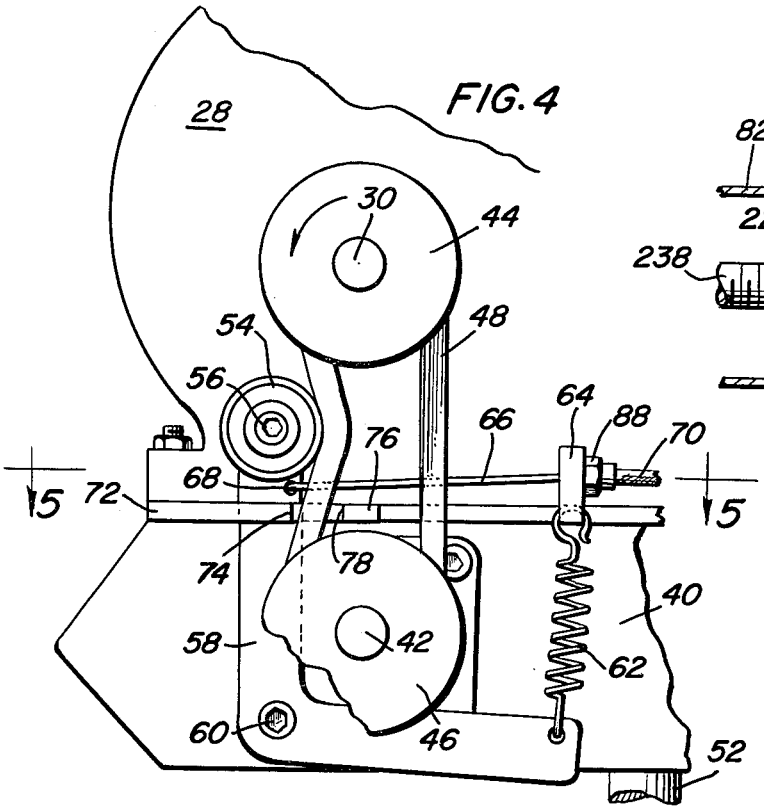
FIG. 4 is a fragmentary, side elevational view of engine and gear case components with the guard shield removed illustrating the details of the clutch mechanism.

The driving connection between the belt 48 and the pulleys 44 and 46 is maintained by a movable idler wheel 54 rotatably journaled on a pin or shaft 56 on the end of one arm of a bell crank 58 which has its apex disposed below the idler wheel 54 and pivotally mounted on a pivot pin or bolt 60 connected to the gear box 40 so that pivotal movement of the bell crank 58 about the pivot bolt 60 in one direction will bring the idler wheel 54 into engagement with the belt 48 thus tensioning the belt 48 and transmitting driving force from the pulley 44 to the pulley 46. When the bell crank 58 is moved in the other direction, the idler wheel 54 is moved away from the belt 48 thus loosening the belt and enabling the pulley 44 to rotate in relation to the loose belt 48. A tension coil spring 62 interconnects the end of the bell crank 58 remote from the idler wheel 54 with bracket 64 which is attached to the base of the engine 28 where it joins with the gear box 40 in any suitable manner, thereby spring biasing the bell crank 58 in a direction so that the idler wheel 54 is spring biased away from the belt 48. An operating flexible cable 66 has a terminal end connected to the bell crank 58 at attachment point 68 adjacent the idler wheel 54 as illustrated in FIG. 4 and the cable 66 extends through the bracket 64 and an attached flexible housing 70 so that when the cable 66 is tensioned, it will overcome the spring 62 and maintain the idler wheel 54 in a position to tighten the belt 48 and cause the belt 48 to transmit driving torque from the pulley 44 to the pulley 46 in a manner well-known in the art.

Figure 5:
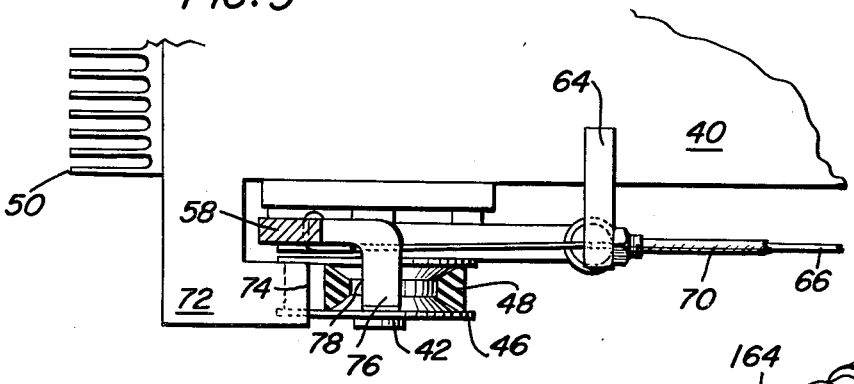
FIG. 5 is a sectional view taken substantially upon a plane passing along section line 5—5 on FIG. 4, showing further details of the clutch mechanism.

A brake structure is provided for the belt 48 to promptly stop the belt 48 when it is loosened due to movement of the idler wheel 54 away from the belt 48. This brake structure is in the form of a rigidly mounted stationary tab 72 rigidly secured to the engine base where it joins with the gear box with the tab 72 being stationary and including a belt engaging abutment surface 74 which is parallel to the outer surface of the belt 48 and normally spaced slightly away from the belt 48 when the idler wheel 54 is in belt tightening position as illustrated in FIGS. 4 and 5. The other component of the brake structure is a movable tab 76 of L-shaped construction as illustrated in FIG. 5 which is rigidly affixed to the bell crank 58 adjacent the point of attachment 68 of the cable 66 with the free end of the movable tab 76 projecting internally of the belt 48 and provided with a belt engaging surface 78 which is disposed in spaced parallel relation to the belt engaging abutment surface 74 and is spaced away from the inner surface of the belt 48 when the idler wheel 54 and bell crank 58 are in belt tightening position, as illustrated in FIGS. 4 and 5. When the cable 66 is permitted to move to belt loosening position, the spring 62 pivots the bell crank 58 so that the idler wheel 54 moves away from the belt 48 and at the same time, the movable tab 76 and belt engaging surface 78 thereon move toward the inner surface of the belt 48 and will pinch the belt 48 between the stationary belt engaging abutment surface 74 and the belt engaging surface 78 on the movable tab 76, thereby quickly and rapidly stopping the belt 48 thus assuring that the belt 46 will cease movement almost immediately upon loosening of the belt 48, thereby quickly and rapidly braking the troweling blade assembly 22 so that it will be promptly stopped in response to release of tension on the cable 66. The driving structure and clutch and brake structure is provided with a removable protective guard 80 to prevent the operator or others from accidentally coming into contact with the driving mechanism and clutching and braking mechanism.

Figure 10:
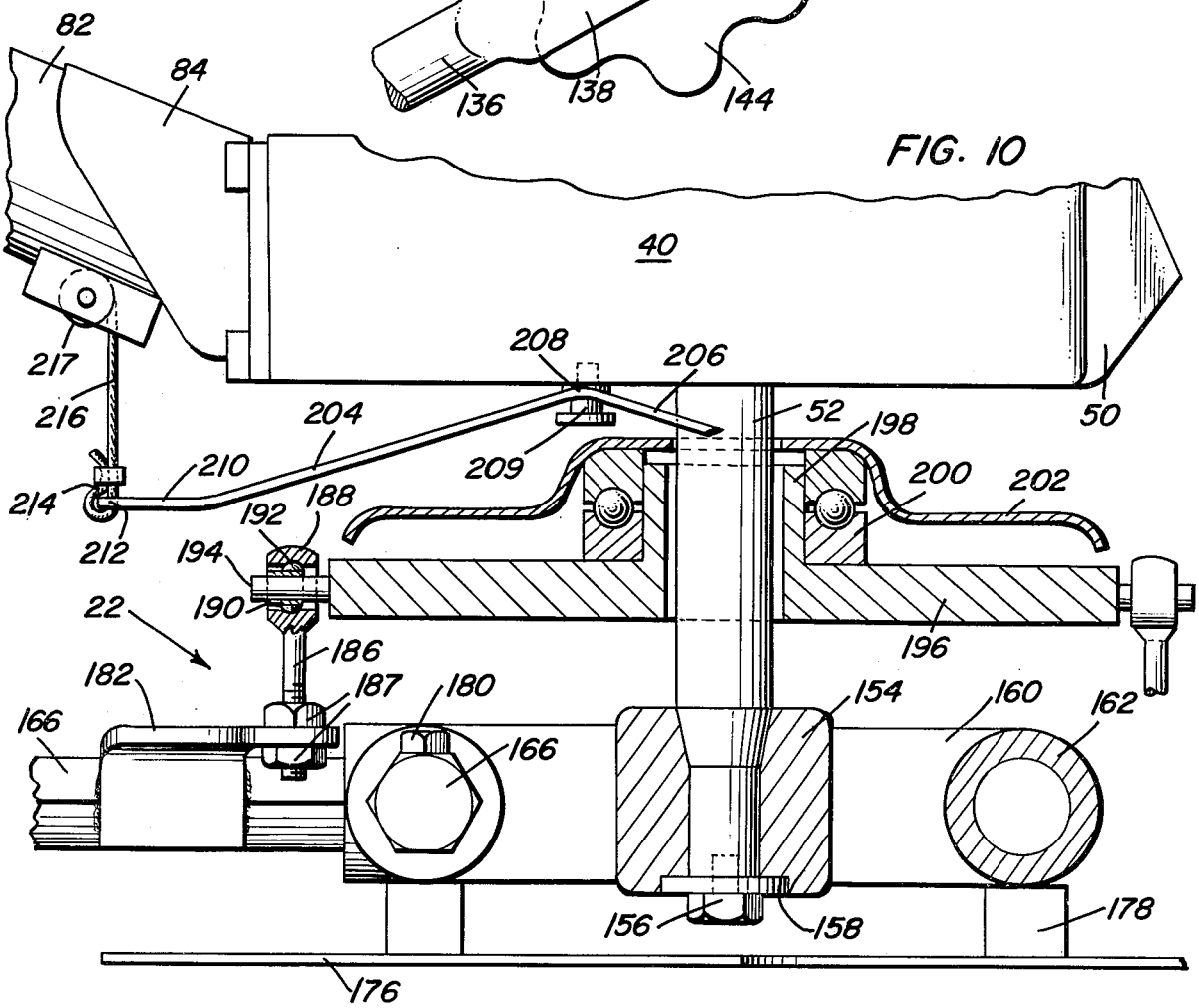
FIG. 10 is a sectional view taken substantially upon a vertical plane passing through the center of the blade assembly, the handle and the blade tilting assembly.

The mechanism for automatically loosening the belt 48 and applying the brake to the belt 48 is incorporated into the handle assembly which includes an elongated tubular handle 82 that is rigidly affixed to the gear box 40 by a bracket structure 84, as illustrated in FIG. 10, with the bracket structure being rigidly affixed to the gear box 40 in any suitable manner and the tubular handle 82 rigidly affixed to the bracket 84 and extending upwardly therefrom in an inclined manner to a handle bar or hand grip assembly generally designated by numeral 86 at the upper end thereof for control of the trowel 20 by an operator. The control cable 66 and its flexible housing 70 extends longitudinally in the tubular handle 82 as illustrated in FIG. 2 with these components exiting from the lower end of the handle 82 and continuing to the bracket 64 with the flexible housing 70 being anchored to the bracket 64 by a retaining nut 88 with the cable passing through the bracket 64 for connection with the bell crank in a well-known manner. The other end of the cable 66 and its flexible housing 70 extends out through an opening 90 in the tubular handle 82 and into a housing 92 which is longitudinally split with the two halves being secured together with fasteners 94 which extend through sleeve-like standoffs 96, one of which is provided with a rubber sleeve 98 thereon for a purpose described hereinafter. One-half of the housing 92 may be secured to the tubular handle 82 by any suitable means, such as by fasteners extending into the interior of the handle or by clamps which encircle the tubular handle 82 in order to fixedly secure the housing 92 adjacent the upper end of the tubular handle 82 so that an operator controlling the trowel from the handle bars 86 has ready access to the housing 92. Pivotally mounted with respect to the housing 92 is a lever 100 having its inner end pivotally connected to the interior of the housing 92 by a pivot pin 102 with the central portion of the lever extending through an arcuate slot 104 in the rearward curved edge of the housing 92. The outer end of the lever 100 is provided with a weight 106 in the form of a spherical ball and, as illustrated in FIG. 3, the lever 100 is slightly angulated and the ball 106 not only serves as a weight but serves as a handle or knob for the lever 100 to enable manual manipulation thereof or movement of the lever 100 in response to centrifugal force when the handle 82 swings about a vertical axis generally defined by the rotational center of the blade assembly 22.

Figure 3:
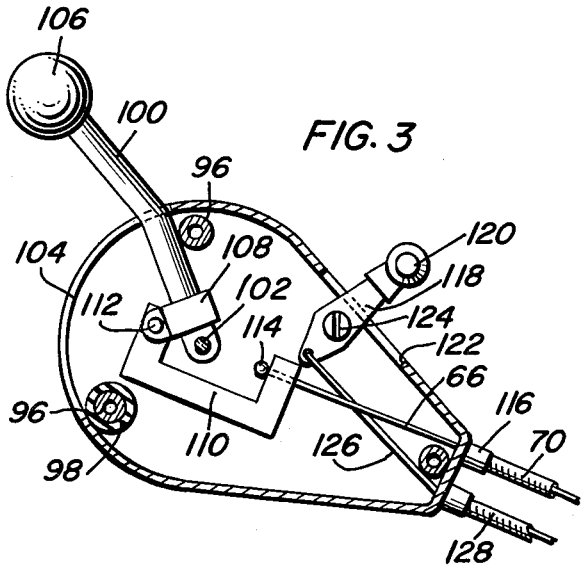
FIG. 3 is a sectional view taken substantially upon a plane passing along section line 3—3 on FIG. 2, showing details of the clutch and throttle lever assembly.

Adjacent the pivot pin 102, the lever 100 is provided with a bracket 108 secured thereto which is pivotally connected to one end of a generally U-shaped connecting bracket 110 by a pivot pin 112 at one end of the bracket 110 with the other end of the bracket 110 being connected to the upper terminal end of the cable 66 as at connecting point 114 as illustrated in FIG. 3. The upper end of the flexible housing 70 for the cable 66 is anchored by the ferrule 116 so that longitudinal movement of the cable 66 in relation to the cable housing 70 will occur during pivotal movement of the lever 100 and corresponding movement of the connecting bracket 110. As illustrated in FIG. 3, the force exerted on the connecting bracket 110 by the tension which constantly exists on cable 66 due to the spring 62 will maintain the pivot axis defined by the pivot pin 112 above the pivot pin 102, that is in an over center relationship so that the lever 100 will be retained in the upwardly inclined position against the edge of the slot 104 or the standoff sleeve 96. However, if the handle 82 begins to swing, such as would occur if the operator lost control of the trowel, the centrifugal forces caused by the angular acceleration of the weight or knob 106 will overcome the tension exerted on cable 66 by spring 62 and cause the lever 100 to swing downwardly in a counterclockwise direction about pivot pin 102 as indicated by the arrow in FIG. 3 and as soon as the pivot axis defined by the pivot pin 112 moves downwardly below a plane passing through the pivot pin 102 and the point of attachment 114, the tension exerted by spring 62 will cause the lever to rapidly come into contact with the rubber sleeve 98 on the lower standoff 96 and at the same time move the bell crank 58 and the idler wheel 54 to a belt loosening position and move the movable belt engaging surface 78 toward the inner surface of the belt and pinch the belt against the stationary abutment surface 74. The rubber sleeve 98 serves to cushion or dampen the shock that lever 100 may create as it swings through its arc.

Also mounted in the housing 92 is a throttle lever 118 having a hand grip 120 on the outer end thereof and extending inwardly through a slot 122 with an intermediate portion being pivotally mounted on the housing 92 by a pivot pin or bolt 124. The innermost end of the throttle lever 118 is connected to a control cable 126 which extends through a flexible housing 128 and in through the opening 90 and thus through the tubular handle 82 to the lower end thereof for connection with the throttle mechanism of the engine 28 in a well-known and conventional manner in order to enable the output speed of the engine to be adjusted and to facilitate starting of the engine. When the engine is started, the clutch lever 100 is moved downwardly to its lowermost position thereby disengaging the clutch and eliminating transfer of driving force to the blade assembly. When this has been accomplished, the engine can be started in a safe manner, since there is no centrifugal clutch operative in response to the speed of the engine which sometimes can be accidentally engaged if the engine is started when the throttle setting is too high. After the engine has been started and it is desired to operate the troweling blade assembly 22, the lever 100 is manually moved upwardly to its engaged position as illustrated in FIG. 3 and thereafter, if the tubular handle 82 swings in an arcuate manner about a center of the rotational axis of the trowelling blade assembly, the centrifugal force resulting from the knob or weight 106 will automatically disengage the clutch and the brake mechanism will terminate transmission of driving torque to the blade assembly, thereby stopping the swinging movement of the handle and eliminating hazards resulting therefrom.

The handle bar or hand grip assembly 86 is connected with the tubular handle 82 in a manner to enable vertical adjustment about a transverse axis in order to adapt the handle bar 86 to the height of the operator to provide optimum control and comfort conditions. The handle bar 86 includes an elongated tubular member 130 which is generally horizontally disposed and generally perpendicular to the upwardly inclined handle 82. The ends of the tubular member 130 are provided with hand grips 132 which are telescoped over the fixedly secured to the ends of the tubular member 130. The central portion of the tubular member 130 is arcuately bowed or concave at 134 which facilitates the operator placing his hip or waist into this area for guiding the trowel without much effort by the hands. A pair of inwardly converging brace members 136 are connected to the outer end portions of the tubular member 130 adjacent the hand grips 132 and converge forwardly and terminate in generally parallel apertured flattened ends 138 which are disposed adjacent opposite ends of a transverse mounting tube 140 rigidly affixed to the undersurface of the tubular handle 82 in any suitable manner, such as welding or the like. Extending through the mounting tube 140 and the apertured ends 138 is a bolt 142 having a hand wheel or serrated knob 144 on one end thereof and a screw threaded nut 146 on the other end thereof by which the handle bar 86 can be pivoted vertically about the axis of the bolt 142 and locked in position by tightening the hand wheel 114 inasmuch as the nut 146 may be fixedly attached to the adjacent flattened end 138 in any suitable manner. A rubber sleeve 148 is interposed between the bolt 142 and the mounting tube 140 and isolates vibration between the bolt and tube. To facilitate locking in adjusted position, an external star washer 150 is interposed between each end of the mounting tube 140 and the flattened ends 138. The conventional star washer 150 includes radial serrations or ridges to facilitate locking of the handle bar 86 in adjusted position when the knob or hand wheel 144 is tightened. When it is desired to adjust the handle bar, the operator loosens the knob or hand wheel 144 which relieves pressure from the external star washers 150, the mounting tube 140 and the flattened ends 138 so that the handle bar then can be lifted or lowered to the desired height and locked in this position by tightening the hand wheel or knob 144. Positioning of the tubular member 130 so that it can swing vertically past the end of the tubular handle 82 enables the handle bar or hand grip assembly 86 to be adjusted over a relatively wide range of adjustment, thereby adapting the trowel 20 for use by operators of different height.

The troweling blade assembly 22 includes a blade arm support spider 152 which includes a central hub 154 mounted on the lower end of the output shaft 52 from the gear box 40 and retained thereon by a bolt 156 and a washer 158 with the bolt threading into the lower tapered end of the shaft 52 with the hub 154 being correspondingly shaped for rigidly but detachably mounting the spider on the shaft. The relationship of the hub 154 and output shaft 52 is illustrated in FIG. 10 with the structure of the spider 152 being illustrated in FIG. 11 with a plurality of radially extending supporting webs 160 extending outwardly from the hub 154 and each pair of webs 160 has integrally formed thereon a horizontally disposed sleeve 162 which rotatably journals a cylindrical end portion 164 of a hexagonally shaped blade supporting arm 166. The cylindrical end 164 of the arm 166 is rotatably journaled in the sleeve 162 and includes a peripheral groove 168 which receives the inner end of an arm retaining bolt 170 which is in the form of a set screw or the like threaded through the sleeve with the inner end received in the groove 168 to enable rotation of the arm 166 about its longitudinal axis but prevent removal thereof until such time as the arm retaining bolt 170 is removed. A lubrication fitting 172 for grease or the like is provided in each sleeve 162 and the inner surface of the sleeve 162 is provided with an undercut portion 174 to provide a space for receiving lubricant, thereby reducing wear between the sleeve and cylindrical end portion 164 of the arm 166 when the device is being used. As illustrated, four sleeves 162 are provided and correspondingly four blade supporting arms 166 are utilized, but it is pointed out that a three arm spider may be utilized as well as the four arm spider as illustrated.

Figure 12:
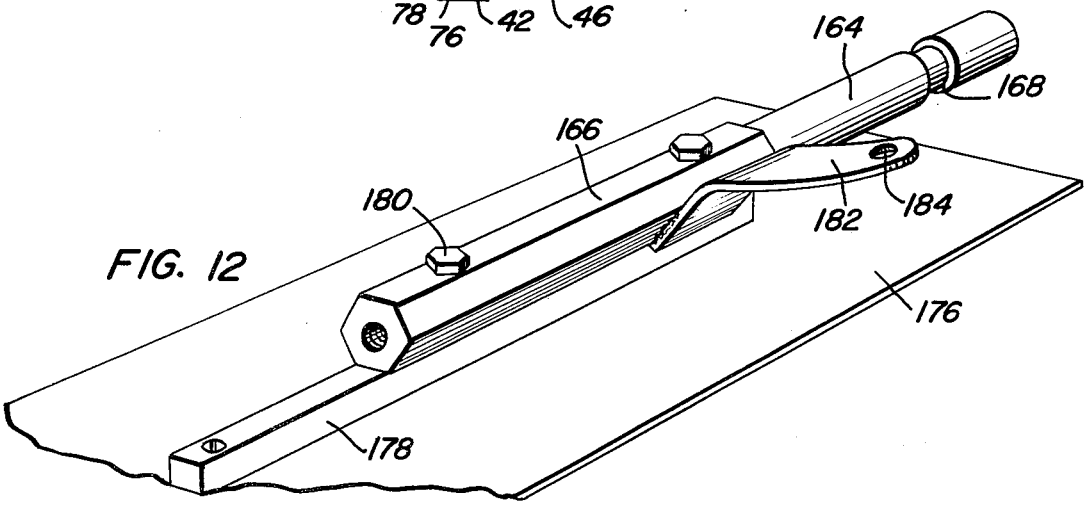
FIG. 12 is a perspective view of one trowel blade and associated mounting means, disassembled from its bearing mount.
Figure 7:
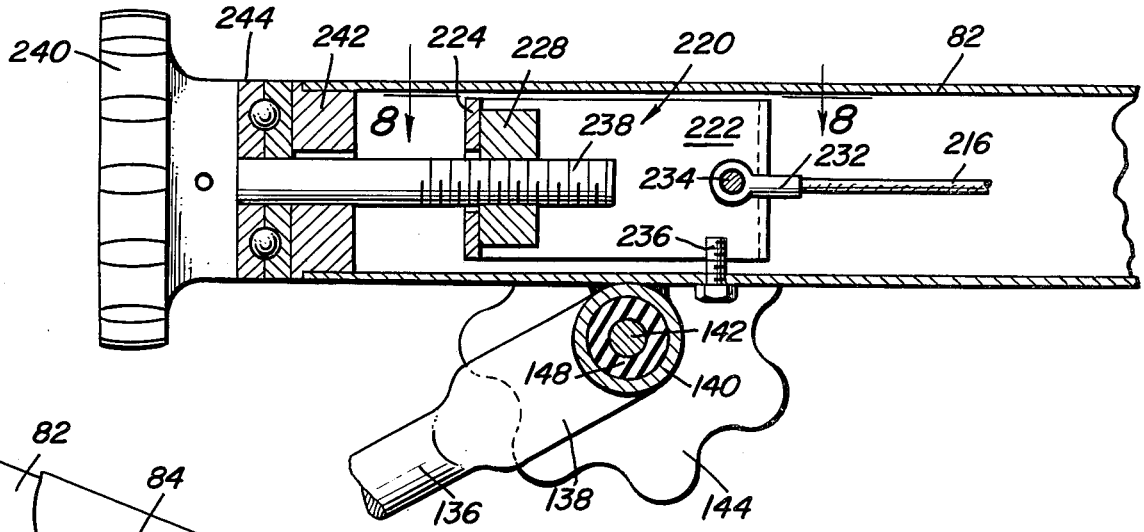
FIG. 7 is an enlarged sectional view taken substantially upon a plane passing along section line 7—7 on FIG. 2, showing details of the means for manually activating the blade tilting mechanism.

Supported from each of the blade supporting arms 166 is a troweling blade 176 having a longitudinally extending rib or bar 178 extending longitudinally along the center upper surface thereof as illustrated in FIG. 12 with the rib engaging the lower flat surface of the hexagonal arm 166. Fastening bolts 180 extend through the hexagonal arm 166 from the flat top surface thereof into the rib 178 thus detachably securing the troweling blade 176 to the support arm 166. This structure enables replacement of the blades as well as the arms when necessary and also enables interchangeability of various types of blades in order to adapt the trowel for use in various surface finishing operations.

In order to tilt and control the pitch of the blades 176, each of the blade supporting arms 166 is provided with a laterally extending, upwardly inclined lug or ear 182 having an aperture 184 in the free end thereof for receiving the lower threaded end of a rod 186 having a pair of nuts 187 threaded thereon and engaging the top and bottom surfaces of the lug 182 as illustrated in FIG. 10, thus securely and adjustably connecting the rod 186 to the hexagonal support arm 166. The rod 186 is a commercially available item identified as a "rod end" and manufactured by Superior Products, New Haven, Indiana, and which includes an annular upper end 188 having an inner annular member 190 connected thereto with a modified ball joint 192 to enable universal tilting of the inner annular member 190 in relation to the outer annular member 188. The inner annular member 190 receives a projecting pin 194 therein which is rigidly affixed to the periphery of a thrust plate 196 which includes a central vertical hub 198 projecting upwardly therefrom and which extends interiorly of a thrust bearing assembly 200 which rests on the upper surface of the thrust plate and encircles the upwardly extending portion of the hub 198 with the upper end of the thrust bearing assembly being received under and engaged by a thrust bearing cover plate 202 with the thrust plate 196, thrust bearing assembly 200 and thrust bearing cover plate 202 all being vertically movable with respect to the shaft 52 with such movement causing vertical displacement of the rods 186 and thus tilting or varying the pitch of the troweling blades 176.

Figure 8:
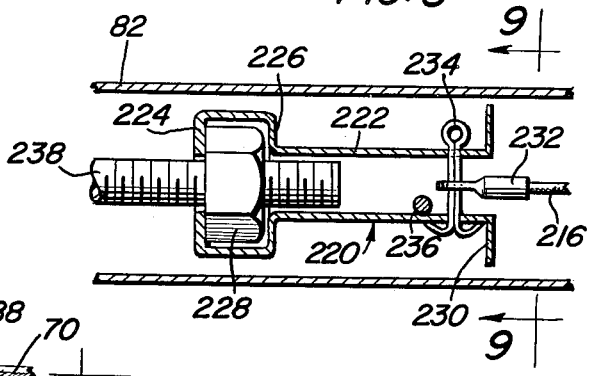
FIG. 8 is a fragmental sectional view taken substantially upon a plane passing along section line 8—8 on FIG. 7.
Figure 9:
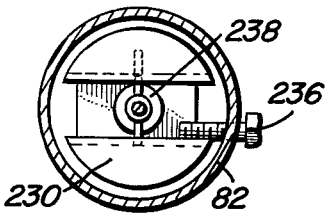
FIG. 9 is a transverse sectional view taken substantially upon a plane passing along section line 9—9 on FIG. 8.

Downward force is exerted on the cover plate 202 and thrust bearing assembly 200 through a tilt control fork 204 of angulated configuration with one end thereof being bifurcated at 206 to form two legs which straddle the output shaft 52 and engage the cover plate 202 on opposite sides thereof. Adjacent to but spaced from the bifurcated end 206 of the tilt control fork 204, an offset or bend is provided which forms a fulcrum 208 engaged with shoulder bolts 209 on the undersurface of the gear box 40, as illustrated in FIG. 10, with the remainder of the tilt control fork 204 extending donwardly in an inclined direction and tapering to a narrow end portion 210 having an aperture 212 therethrough receiving the looped end 214 of an operating cable 216 which extends over a roller or pulley 217 on the undersurface of the tubular handle 82 where it joins with the bracket 84 as illustrated in FIG. 10. The cable 216 extends longitudinally through the tubular handle 82 toward the upper end thereof for connection with a tilt control mechanism generally designated by the numeral 218 and which includes a generally U-shaped housing generally designated by numeral 220 that is longitudinally movable in the tubular handle 82 and includes a pair of generally parallel legs 222 interconnected by a bight portion 224. Each of the legs 222 is provided with an offset portion 226 in spaced relation to the bight portion 224 for captively receiving a nut 228 therein as illustrated in FIG. 8. The terminal ends of the legs 222 extend laterally outward as indicated by numeral 230 and the cable 216 extends between the terminal ends of the legs and includes a ferrule 232 having an aperture received on a transverse cotter pin 234 or the like which extends between the legs 222 as illustrated in FIGS. 8 and 9. To prevent rotation of the housing 220 within the tubular handle 82, a screw 236 extends in through the handle 82 in the space between the legs 222 to prevent the housing 220 from rotating within the tubular handle 82. An elongated threaded bolt 238 is inserted through the nut 228 and is in screw threaded engagement therewith and also extends through the bight portion 224 and between the legs 222 as illustrated in FIG. 8. The opposite end of the bolt 238 is provided with a rigid knob or hand wheel 240. The bolt 238 is guided by a bushing 242 in the end of the tubular handle 82 and a thrust bearing assembly 244 is interposed between the bushing and the knob 240 to reduce the torque necessary to rotate the hand wheel 240. Thus, by rotating the hand wheel 240 and tensioning the cable 216, the tilt control fork 204 may be fulcrumed about fulcrum area 208 with the bifurcated end 206 forcing the cover plate 202, thrust bearing assembly 200 and thrust plate 196 downwardly, thus pivoting the blade supporting arms 166 and the blades 176 about the longitudinal axes of the arms 166, thus varying the pitch of the blades 176 with the tendency of the blades to assume a flat condition upon a supporting surface keeping the cable 216 taut within the limits of the range of movement of the housing 220 with any suitable means being provided to prevent the bolt 238 from completely unthreading from the nut 228.

A conventional guard ring 246 is disposed adjacent the tip of the blades 176 with the guard ring being supported by upwardly offset radially extending support arms 248 attached rigidly to the gear case in any suitable manner so that the guard ring may be used to facilitate carrying or handling of the trowel. The guard ring also enables finishing of a surface close to a vertical wall or other obstruction without the blades coming into contact with the obstruction or wall. Also, a stabilizing and gyroscopic ring 250 is attached to the outer end of the blade supporting arms 166 by a depending supporting tab 252 and a pivot bolt 254 extending into the end of the arm 166 so that the ring 250 may be removed and interchanged with rings having different weight characteristics depending upon the size of the structure from which the ring is constructed. The stabilizing ring of lightweight construction provides for a light trowel used when the concrete is soft and by substituting a heavy ring, more effective troweling can be provided when the concrete has set up a little too much. The heavy ring 250 serves as a gyroscopic ring in that the moving weight provides a gyroscopic effect which is concentric as compared to conventional methods of weighting a trowel, such as adding concrete blocks and the like which not only are stationary but also raise the center of gravity of the trowel, whereas the use of a weighted ring 250 enhances the trowel balance due to the lowering of the center of gravity of the trowel as well as the gyroscopic effect. The ring 250 may be easily removed by removing the pivot bolts 254 with the ring 250 being removable and replaceable without removing any of the blades and without removing the stationary guard ring 246.

The rotary power trowel 20 more effectively provides a smooth finish to concrete by providing an adjustable handle to enable the operator to more effectively control and manipulate the trowel, a safety clutch and brake which will immediately stop rotational torque from being transmitted to the troweling blade assembly in the event the operator loses control of the trowel, an easily adjusted pitch control adjustable from the handle area of the trowel, capable of operation with three or four troweling blades and capable of being converted from a light trowel to a heavy trowel by substituting a heavier gyroscopic ring for the lighter stabilizer ring which provides a balanced trowel with a low center of gravity and a gyroscopic effect provided by the heavier gyroscopic ring.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a rotary powered trowel having prime mover means, a troweling blade assembly, drive means interconnecting the prime mover means and blade assembly to rotate said blade assembly, and handle means connected to said trowel to enable an operator to manipulate and control the trowel, that improvement comprising clutch means forming a part of said drive means to selectively transmit driving torque to said blade assembly, said clutch means including actuator means supported in spaced relation to the rotational axis of the blade assembly for disengaging the clutch means in response to centrifugal force due to rotation of the trowel about the axis of rotation of the blade assembly if the operator loses control of the handle means during operation of the trowel, and brake means connected with said actuator means for applying a braking force to stop torque transmission to the blade assembly immediately upon disengagement of the clutch means for stopping swinging movement of the handle means before it swings one revolution thereby protecting the operator from being struck by the handle means.

2. The structure as defined in claim 1 wherein said prime mover means includes an engine, said drive means including a gear box and a belt drive means drivingly interconnecting the engine and gear box, said belt drive means including a pair of spaced, aligned pulleys and an encircling drive belt, said clutch means including an idler engaging the drive belt to maintain the belt taut or permit the belt to be loosened and remain stationary, said idler being rotatably journaled on a pivotally supported lever, said actuator means being connected to said lever for selective positioning the idler in relation to the drive belt.

3. The structure as defined in claim 2 wherein said actuator means includes an operating cable extending along the handle means and terminating in spaced relation to the engine and blade assembly, said brake means including a stationary belt engaging surface and a movable belt engaging surface connected with said lever and disposed in spaced relation to the belt when the idler is in belt tensioning position with the idler maintaining the belt in spaced relation to the stationary belt engaging surface when the idler is in belt tightening position, said stationary surface and movable surface being on opposite sides of the belt with the movable surface moving into engagement with the belt and pinching the belt between the stationary and movable belt engaging surfaces when the lever and idler are moved to belt loosening position thereby immediately applying a braking force to the driving belt when the idler is moved to belt loosening position.

4. The structure as defined in claim 3 wherein said lever is in the form of a bell crank having its apex pivotally supported with the idler at one end of the bell crank, the other end of the bell crank including a spring biasing the bell crank and idler to belt loosening position, said cable being attached to the bell crank adjacent the idler for maintaining the idler in belt tightening position, said actuator means including a weighted lever mounted on the handle means for pivotal movement in response to angular acceleration of the handle means about the axis of rotation of the blade assembly, an over center means connected to the weighted lever and cable for maintaining the cable and idler in belt tightening position during normal operation and manipulation of the trowel with the spring maintaining the weighted lever in its over center position, said weighted lever being pivoted to release the over center means so that the spring can move the bell crank and idler to belt loosening position and applying the brake means, said weighted lever being manually movable to belt loosening position when starting the engine to prevent accidental swinging of the handle means in the event the engine starts at a relatively high speed.

5. The structure as defined in claim 1 wherein said troweling blade assembly includes support means connected with and driven by the drive means, said support means including a plurality of sleeves, a blade support arm mounted in each of the sleeves and projecting outwardly therefrom for angular movement about the longitudinal axis of the blade support arm, a longitudinally elongated blade attached to each blade support arm, and means connected with each blade support arm to tilt the blade support arm and blade to vary the pitch of the blade.

6. The structure as defined in claim 5 wherein said means for tilting of the blade includes an offset lug attached to each blade supporting arm, a vertically movable thrust plate disposed above the support sleeves for the blade support arms, connecting rods universally connecting the thrust plate and lugs, a thrust bearing engaged with the thrust plate, and means operative from the handle means remote from the prime mover means to apply downward thrust on said thrust bearing, thrust plate and lugs to vary the pitch of the blades about the longitudinal axis of the portion of the blade supporting arms received in the support sleeves.

7. The structure as defined in claim 6 wherein said means to apply downward thrust on thrust bearing includes a lever having a bifurcated end engaging the thrust bearing and a fulcrum portion intermediate the ends thereof for engaging a stationary support, the other end of the fulcrumed lever connected with a cable extending along the handle means and connected to a manual actuating means for moving the cable longitudinally and applying or releasing downward thrust on the thrust bearing and thrust plate.

8. The structure as defined in claim 7 wherein said actuating means includes a rotatable knob mounted at the end of the handle means and a movable member mounted on the handle means and connected with the knob by a screw threaded connection whereby rotation of the knob will move the cable longitudinally for applying and releasing downward thrust on the thrust bearing and thrust plate.

9. The structure as defined in claim 4 wherein said troweling blade assembly includes support means connected with and driven by the drive means, said support means including a plurality of sleeves, a blade support arm mounted in each of the sleeves and projecting outwardly therefrom for angular movement about the longitudinal axis of the blade support arm, a longitudinally elongated blade attached to each blade support arm, and means connected with each support arm to tilt the blade support arm and blade to vary the pitch of the balde.

10. The structure as defined in claim 1 wherein said blade assembly includes a plurality of rotating blades and support arms therefor, a stabilizer ring mounted on the support arms for the blades, means detachably mounting the ring on the support arms to enable interchange of the ring to increase or decrease the weight of the trowel and to balance the rotating blade assembly, lower the center of gravity thereof and stabilize the trowel by the gyroscopic effect of the rotating weight of the ring.

11. The structure as defined in claim 9 wherein said blade assembly includes a stabilizer ring mounted on the support arms for the blades, means detachably mounting the ring on the support arms to enable interchange of the ring to increase or decrease the weight of the trowel and to balance the rotating blade assembly, lower the center of gravity thereof and stabilize the trowel by the gyroscopic effect of the rotating weight of the ring.

12. The structure as defined in claim 1 wherein said handle means includes an elongated, upwardly inclined handle member, a handle bar assembly attached to the upper end of the handle member and means adjusting the position of the handle bar assembly vertically to facilitate positioning of the handle bar assembly at optimum height for each operator of the trowel.

13. The structure as defined in claim 12 wherein said handle bar assembly includes an elongated member extending transversely of the handle member and terminating in hand grips, forwardly converging brace members attached to the transverse member and terminating in parallel flattened end portions, said handle member having a transverse tube rigidly affixed thereto with the end portions of the brace members disposed along opposite ends of the transverse tube on the handle member, clamp bolt means extending through the end portions of the brace members and the transverse tube and including a hand knob to enable tightening and loosening of the end portions of the brace members in relation to the transverse tube, said transverse tube being provided with a sleeve of resilient material and means interposed between the ends of the tube and the end portions of the brace members to securely lock the brace members in angular relation to the tube when the knob is rotated to a handle bar assembly locking position, said transverse member having the hand grips on the ends being concave to enable an operator to engage this area with his hip or other portions of his anatomy to enable control of the trowel with minimum engagement of his hands with the hand grips.

14. The structure as defined in claim 11 wherein said handle means includes an elongated, upwardly inclined handle member, a handle bar assembly attached to the upper end of the handle member and means adjusting the position of the handle bar assembly vertically to facilitate positioning of the handle bar assembly at optimum height for each operator of the trowel.

15. In a rotary powered trowel having prime mover means, a troweling blade assembly, drive means interconnecting the prime mover means and blade assembly to rotate said blade assembly, and handle means connected to said trowel to enable an operator to manipulate and control the trowel, that improvement comprising clutch means forming a part of said drive means to selectively transmit driving torque to said blade assembly, said clutch means including actuator means supported in spaced relation to the rotational axis of the blade assembly for disengaging the clutch means in response to centrifugal force due to rotation of the trowel about the axis of rotation of the blade assembly when the operator loses control of the handle means during operation of the trowel, and brake means for applying a braking force to stop rotation of the blade assembly immediately upon disengagement of the clutch means for immediately stopping rotational movement of the handle means about the axis of rotation of the blade assembly thereby protecting the operator from being struck by the handle means.

16. In a rotary powered trowel having prime mover means, a troweling blade assembly, drive means interconnecting the prime mover means and blade assembly to rotate said blade assembly, and handle means connected to said trowel to enable an operator to manipulate and control the trowel, that improvement comprising said troweling blade assembly including support means connected with and driven by the drive means, said support means including a plurality of sleeves, a blade support arm mounted in each of the sleeves and projecting outwardly therefrom for angular movement about the longitudinal axis of the blade support arm, a longitudinally elongated blade attached to each blade support arm, and means connected with each blade support arm to tilt the blade support arm and blade to vary the pitch of the blade, said means for tilting the blade including an offset lug attached to each blade supporting arm outwardly of the sleeve, a vertically movable thrust plate disposed above the support sleeves for the blade support arms, connecting rods universally, adjustably and positively connecting the thrust plate and lugs, a thrust bearing engaged with the thrust plate, and means operative from the handle means remote from the prime mover means to apply downward thrust on said thrust bearing, thrust plate and lugs to vary the pitch of the blades about the longitudinal axis of the portion of the blade supporting arms received in the support sleeves, said connecting rods preventing the blade from flopping freely when the trowel is lifted with the blades spaced from the working surface.

17. In a rotary powered trowel having prime mover means, a troweling blade assembly, drive means interconnecting the prime mover means and blade assembly to rotate said blade assembly, and handle means connected to said trowel to enable an operator to manipulate and control the trowel, that improvement comprising a plurality of rotating blades and support arms therefor, said support arms being pivotable about a longitudinal axis to tilt the blades, a stabilizer ring mounted on the support arms for the blades, means detachably and pivotally mounting the ring to the ends of the support arms to enable pivotal movement of the support arms and interchange of the ring to increase or decrease the weight of the trowel and to balance the rotating blade assembly, lower the center of gravity thereof and stabilize the trowel by the gyroscopic effect of the rotating weight of the ring.

18. In a rotary powered trowel having prime mover means, a troweling blade assembly, drive means interconnecting the prime mover means and blade assembly to rotate said blade assembly, and handle means connected to said trowel to enable an operator to manipulate and control the trowel, that improvement comprising said handle means including an elongated, upwardly inclined handle member, a handle bar assembly attached to the upper end of the handle member and means adjusting the position of the handle bar assembly vertically to facilitate positioning of the handle bar assembly at optimum height for each operator of the trowel, said handle bar assembly including an elongated member extending transversely of the handle member and terminating in hand grips, forwardly converging brace members attached to the transverse member and terminating in parallel flattened ends, said handle member having a transverse tube rigidly affixed thereto with the ends of the brace members disposed along opposite ends of the transverse tube on the handle member, clamp bolt means extending through the ends of the brace members and the transverse tube and including a hand knob to enable tightening and loosening of the ends of the brace members in relation to the transverse tube, said transverse tube being provided with a sleeve of resilient material and means interposed between the ends of the tube and the ends of the brace members to securely lock the brace members in angular relation to the tube when the knob is rotated to a handle bar assembly locking position, said transverse member having the hand grips on the ends being concave to enable an operator to engage this area with his hip or other portions of his anatomy to enable control of the trowel with minimum engagement of his hands with the hand grips.

* * * * *